United States Patent [19]

Teegarden et al.

[11] 4,382,749

[45] May 10, 1983

[54] RECIPROCATING COMPRESSOR WITH INTEGRAL UNLOADER VALVE

[75] Inventors: Arlo F. Teegarden; Jerome C. Roach, both of La Crosse, Wis.

[73] Assignee: The Trane Company, La Crosse, Wis.

[21] Appl. No.: 206,750

[22] Filed: Nov. 14, 1980

[51] Int. Cl.[3] ..... F04B 49/02; F04B 35/04

[52] U.S. Cl. ..... 417/295; 417/415; 417/441

[58] Field of Search ..... 417/295, 415, 441

[56] References Cited

U.S. PATENT DOCUMENTS

| | | | |
|---|---|---|---|
| 2,054,640 | 9/1936 | Stenger | 417/295 |
| 2,225,228 | 12/1940 | Neeson | 417/415 |
| 2,350,537 | 1/1941 | Scott | 417/295 |
| 2,751,145 | 6/1956 | Olcott | 417/415 |
| 3,061,176 | 10/1962 | Nicholas | 417/295 X |
| 3,578,883 | 5/1971 | Cheney et al. | 417/286 |
| 3,671,147 | 12/1972 | Lauchs et al. | 417/286 |

FOREIGN PATENT DOCUMENTS

| | | | |
|---|---|---|---|
| 9145 | 4/1980 | European Pat. Off. | 417/295 |

*Primary Examiner*—Richard E. Gluck

*Attorney, Agent, or Firm*—Carl M. Lewis; Peter D. Ferguson; Ronald M. Anderson

[57] ABSTRACT

A multi-cylinder reciprocating compressor is disclosed which is provided with an unloader valve for blocking the flow of suction gas to at least one of the cylinders to reduce the compressor capacity. The unloader valve is disposed at one end of a cylinder bank and comprises an unloader piston and an unloader port which is an integral part of the cylinder bank. A chamber in which the unloader piston and unloader port are located is formed in the cylinder bank with its axial center in parallel alignment with the axial center of all the cylinders in that bank. This improved efficiency, facilitates ease of manufacture, and reduces associated costs.

12 Claims, 4 Drawing Figures

RECIPROCATING COMPRESSOR WITH INTEGRAL UNLOADER VALVE

DESCRIPTION

1. Technical Field

This invention generally pertains to reciprocating multi-cylinder compressors with unloading means, and specifically to such a compressor wherein a suction gas shut-off unloader valve is provided as an integral part of a cylinder bank.

2. Background Art

The advantages of matching the capacity of a machine to its intended work load are readily evident, not the least of which is the resulting savings in energy. In recent years, this has become an increasingly important consideration in the design of air conditioning equipment, especially of refrigerant compressors in which capacity may be controlled to match the air conditioning demand.

Although there are several ways of controlling the capacity of a multi-cylinder compressor, one of the more efficient methods is simply to block the flow of suction gas to one or more of the cylinders. Thus unloaded, a cylinder does not contribute to the total volume of compressed fluid discharged from the compressor; only minimal work is expended in the unloaded cylinder, primarily as a result of the frictional losses associated with the continued motion of the piston. The compressor therefore uses less energy, while producing a smaller volume of compressed fluid required to meet a reduced demand.

Compressor designs incorporating this type capacity control are disclosed in U.S. Pat. Nos.: 2,350,537; 3,061,176; 3,578,883; and 3,671,147. For example, in the compressor shown in the '537 patent, an unloader piston disposed in one of the cylinder heads controls the flow of suction gas through a port in a valve plate in which are also located the suction and discharge valves. The unloader valve shown in the '883 patent is also located in the cylinder head and is similar is design to that of the '537 patent.

In a substantially different design, the '176 patent discloses an annular sleeve circumjacent one of the cylinders, which may be hydraulically actuated to control the flow of suction gas to a suction valve for that cylinder.

A relatively simple unloader valve incorporated within a compressor housing containing the cylinders and the crankshaft is shown in the '147 patent. This design provides gas flow passages and a chamber for an unloader piston which are cast into the housing between adjacent cylinders. The unloader valve can thus be built with fewer parts.

To remain competitive in the marketplace, a compressor design should be economically manufactured, particularly if it includes an added cost item such as an unloading valve for suction gas shut-off. One approach that assures manufacturing economy is to design the compressor so that it can be built with simplified castings and with minimum machining costs. The compressor shown in the '147 patent is apparently designed with these goals in mind, since the design provides for casting the unloader valve as an integral part of the crankcase and cylinder housing, which substantially reduces its added cost. However, this compressor requires a greater complexity than necessary in the casting to provide the flow passages for the unloader valve, and the casting must be bored out from several different angles to achieve the machined surfaces for the cylinder bores and the unloader piston chamber.

In consideration thereof, it is an object of this invention to provide a compressor having a suction gas shut-off valve for unloading purposes with a relatively simplified casting for reducing cost and facilitating cleaning during manufacture.

It is a further object of this invention to provide an efficient low cost unloader valve which is an integral part of the cylinder bank of the compressor.

Still a further object of this invention is to provide a compressor design which insures economy in stocking parts required for building compressors of various capacities.

Yet a still further object of this invention is to reduce machining costs of the casting by aligning the chamber for the unloader valve piston with at least one of the cylinders so that they can be bored from a common side.

These and other objects of the invention will become apparent from the drawings and the description of the preferred embodiment which follows.

DISCLOSURE OF THE INVENTION

A reciprocating compressor is disclosed in which a casing defines a plurality of cylinder banks including one or more cylinders, in each of which fluid may be compressed by the reciprocating motion of the piston. Adjacent to and adjoining one end of each cylinder is a valve assembly which includes a suction valve and a discharge valve. Suction gas passages are formed within each cylinder bank, generally circumjacent the cylinders. An inlet port is disposed adjacent the casing and is in fluid communication with the suction valve of each cylinder, to admit fluid to be compressed in the cylinder. The discharge valve of each cylinder is in fluid communication with a discharge gas chamber overlying the valve assemblies of each cylinder bank and is operative to discharge fluid compressed in the cylinder through a discharge port.

The compressor also comprises an unloading valve for controlling the flow of fluid into the suction gas passages of at least one of the cylinder banks. This unloading valve includes as an integral part of the cylinder bank an unloader chamber and an unloader port; the axial center of the unloader chamber is in parallel alignment with the axial center of at least one of the cylinders. The unloader piston is operative to substantially seal the unloader port to control the fluid flow therethrough.

DESCRIPTION OF THE PREFERRED EMBODIMENT

Figure 1:
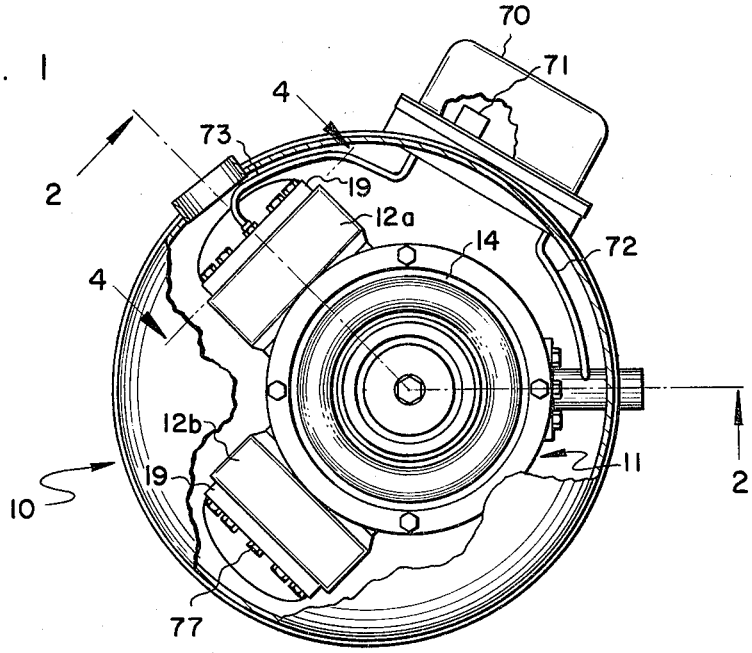
FIG. 1 is an end view of a four-cylinder compressor incorporating a preferred embodiment of the subject invention, with part of its outer shell cut away.
Figure 2:
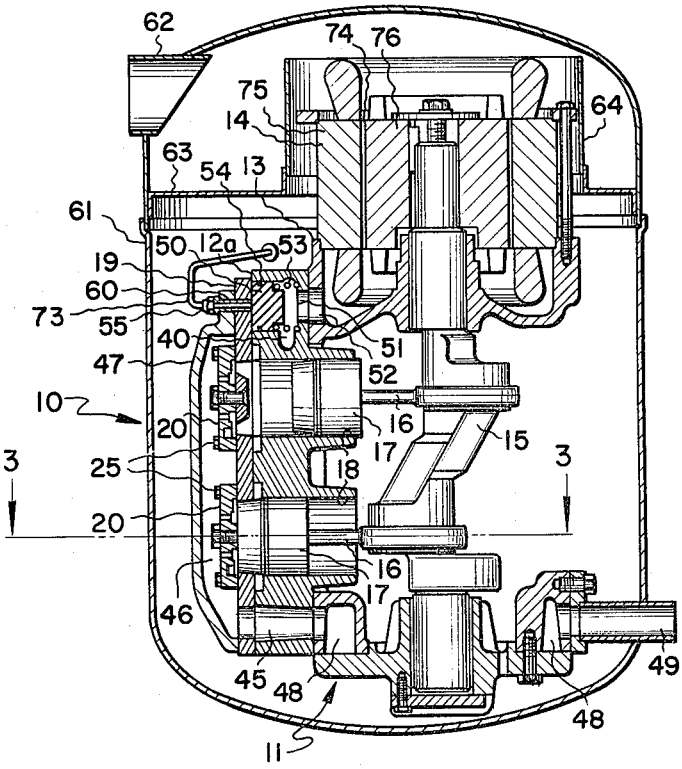
FIG. 2 is a sectional view of the four-cylinder compressor taken along section line 2—2 of FIG. 1, and shows details of a cylinder bank in which an unloader valve is disposed.

Reference numeral 10 generally denotes a four-cylinder reciprocating compressor, as shown in FIGS. 1 and 2. A casing 11 of the compressor 10 comprises cylinder banks 12*a* and 12*b*, radially attached to crankcase 13. An electric motor 14 is provided to drivingly rotate the crankshaft 15, the journaled eccentric lobes of which rotate within the bearings at one end of each of connecting rods 16. The other ends of connecting rods 16 are pivotably attached to pistons 17, such that rotation of crankshaft 15 causes the pistons 17 to reciprocate within cylinders 18. Two cylinders 18 are cast and bored into each of cylinder banks 12*a* and 12*b*. A valve plate 19, along with two valve assemblies 20 are disposed at the outermost surface of each cylinder bank 12*a* and 12*b*.

Figure 3:
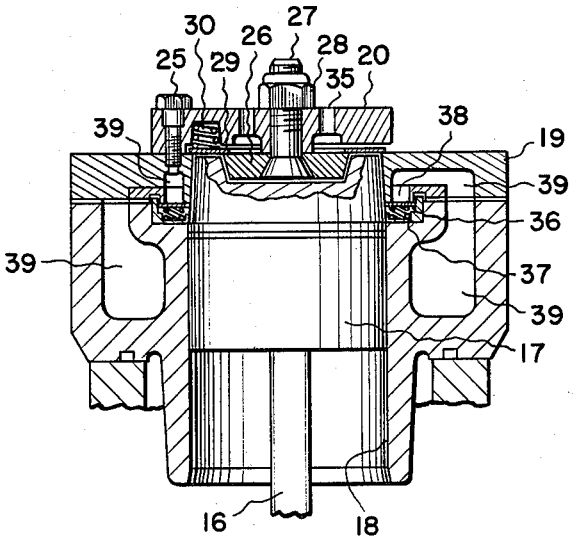
FIG. 3 is a detailed sectional view of one of the cylinder and valve assemblies of the preferred embodiment, taken along section line 3—3 of FIG. 2.

With reference to FIG. 3, details of the suction and discharge valves which are contained within valve plate 19 and valve assembly 20 are fully disclosed. Valve assembly 20 is attached to valve plate 19 by means of bolts 25. An annular cone-shaped metal plate 26 is attached to the internal surface of valve assembly 20, centered in the bore of cylinder 18, by means of bolt 27 and nut 28. An annular flat ring 29 is disposed at the underside of valve plate 20 and is biased by spaced apart helical springs 30 to a rest or "closed" position on the shoulders formed by the periphery of cone-shaped plate 26 and valve plate 19. Discharge gas passages 35 extend through valve assembly 20 at points adjacent to annular ring 29 and are in fluid communication with the interior of cylinders 18 when discharge gas pressure is sufficiently great to unseat annular ring 29 by compressing helical springs 30.

Figure 4:
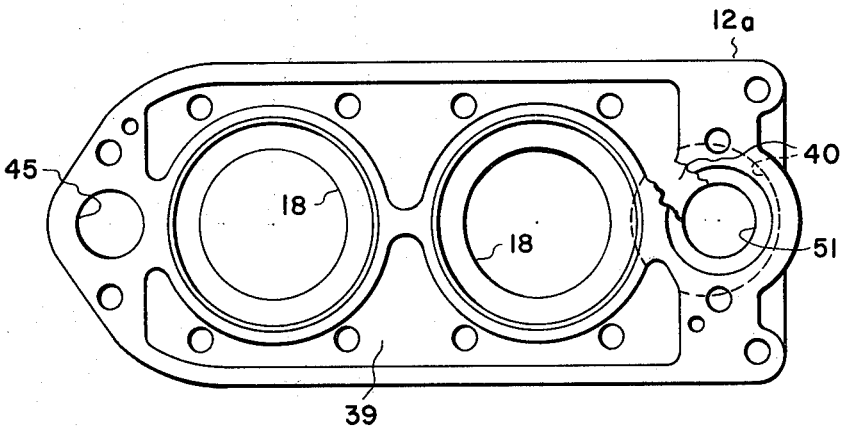
FIG. 4 is a sectional view of the cylinder bank containing the unloader valve, taken along section line 4—4 of FIG. 1.

Turning now to FIGS. 2, 3, and 4, suction gas passages 39 are shown as cast in the cylinder banks 12 circumjacent cylinders 18. Suction gas passages 39 provide fluid communication between suction gas chambers 38 and a suction gas unloader chamber 40. Chamber 40 is cast in cylinder banks 12 at the end adjacent electric motor 14, and in part, is machined to a predetermined cylindrical dimension. At the other end of each cylinder bank 12 is cast a discharge gas passage 45, disposed generally parallel to the cylinder bores 18. Passage 45 is in fluid communication with a chamber 46 defined by cover plate 47 (Ref. FIG. 1), which is attached to valve plate 19 and encloses valve assemblies 20. An annular-shaped passage 48 is formed in the end of crankcase 11 opposite that to which motor 14 is attached, and is operative to convey discharge gas from passage 45 to discharge port 49.

Fitted in chamber 40 and having a maximum diameter slightly less than that of the machined bore of chamber 40 is a generally cylindrical-shaped unloading piston 50. The end of chamber 40 adjacent crankcase 11 has a machined lip 51 which is operative to form a seal in conjunction with an abutting end of unloader piston 50. Lip 51 defines the perimeter of an unloader port 52 which is in fluid communication with crankcase 11. A conical spring 53 is provided between lip 51 and a smaller radius end portion of unloader piston 50, to bias unloader piston 50 to an open position relative to lip 51 and unloader port 52. Conical spring 53 is not required for proper operation of the unloading valve; its inclusion insures faster movement of unloader piston 50 away from lip 51 to load cylinder bank 12*a*.

Although unloader piston 50 could be machined to a very close tolerance to sealingly fit within chamber 40, it has been found more economical to provide piston 50 with a sealing ring 54 inset around its perimeter. Unloader piston 50 is normally actuated to seal against lip 51 of unloader port 52, by pressure applied at its opposite end. As will be explained hereinbelow, discharge gas pressure is selectively applied to the unloader piston 50 to force it to seat against lip 51 to stop the flow of suction gas into cylinders 18 of cylinder bank 12*a*. When the discharge pressure is no longer applied to unloader piston 50, it is desirable that gas pressure within unloader chamber 40 leak past sealing ring 54 sufficiently to permit the unloader piston 50 to move away from the lip 51 of unloader port 52. A passage 60 is provided in cover plate 47 and valve plate 19 and is fitted with a threaded tubing adaptor 55, for applying gas at discharge pressure to the unloader piston 50.

A generally cylindrical-shaped hermetically sealed shell 61 encloses compressor 10 and defines an oil reservoir at the end at which the discharge gas port 49 is disposed. A suction gas port 62 extends through the hermetic shell 61 at the other end thereof. Inside hermetic shell 61 and immediately adjacent suction gas port 62 is a shelf 63 and cylindrical sheet metal wall 64 which define a suction fluid reservoir provided to trap refrigerant liquid which may be conveyed into the hermetic shell 61 through suction gas port 62. It will be understood by those skilled in the art, that compressor 10 is normally operated with the axis of its crankshaft oriented vertically and with the motor at the upper end. Shelf 63 and wall 64 thus trap any refrigerant liquid entering the shell 61, allowing it to be evaporated by the heat produced by electric motor 14, thereby avoiding potential flooding of compressor 10 with liquid refrigerant.

Referring back to FIG. 1, an electrical control panel cover 70 is disposed at one side of and external to the hermetic shell 61 to protect terminal strips and other electrical components which are made accessible by its removal. Included among these electrical components is an electrical solenoid valve 71 connected by internal passages in its mounting plate (not shown) to a tube 72 leading from the discharge gas port 49. The outlet of electrical solenoid valve 71 is further connected to tubing adaptor 55 via tube 73. Electrical solenoid valve 71 is controlled in response to temperature conditioning demand as determined by means external to the compressor and not shown, such as a thermostatic switch.

In operation, compressor 10 receives refrigerant fluid through suction gas port 62. Refrigerant vapor passes from the reservoir area formed by shelf 63 and wall 64, through an inlet port comprising an annular space 74 between stator 75 and rotor 76 of electrical motor 14, thereby providing substantial cooling to the motor windings. Assuming that normal operation of cylinder bank 12*a* is required to meet the temperature conditioning demand, refrigerant vapor is drawn through unloader port 52 and into unloader chamber 50, from whence it passes into suction gas passages 39 of cylinder bank 12*a*. As crankshaft 15 revolves, pistons 17 alternately move up and down, drawing refrigerant vapor into the cylinders 18 on the down stroke. The suction gas passes out of passages 39 through chambers 38, past the suction valves comprising annular rings 36, and finally flows into cylinders 18. On the upstroke of pistons 17, annular rings 36 are biased by helical springs 37 to close and seat against valve plate 19. The charge of refrigerant vapor is thus compressed by the upward moving piston 17 and the pressure of this compressed gas causes annular rings 29 to compress helical springs 30, thereby forcing the compressed refrigerant vapor into passages 35. From passages 35, refrigerant vapor flows through discharge gas passages 45 and annular passage 48, leaving the compressor through discharge port 49.

Under conditions of reduced temperature conditioning demand, electrical solenoid valve 71 is actuated (opened), thereby permitting refrigerant fluid which is at discharge pressure to flow from discharge port 49 through tubes 72 and 73, through passage 60, and into chamber 40. The gas pressure causes unloader piston 50 to compress spring 53 and to seal against lip 51 of unloader port 52. In this position, unloader piston 50 blocks the flow of suction gas to both cylinders 18 of cylinder bank 12*a*. When unloaded in this manner, pistons 17 do a minimal amount of work, expending energy only in the frictional losses resulting from their reciprocating motion. Most of the work expended in compressing residual refrigerant fluid on their up-stroke, is recovered on their down-stroke.

Inspection of FIGS. 2 and 4 will serve to highlight some of the major benefits of this invention over the prior art. It will be observed that the cylinder banks 12*a* and 12*b* are essentially the same, the difference lying in the inclusion of the unloader piston 50 in cylinder bank 12*a*, and its exclusion from cylinder bank 12*b*. Also, in cylinder bank 12*b*, passage 60 is blocked with plug 77 which is threaded therein. Use of a common cylinder bank 12 has the effect of reducing the capital overhead for stocking parts to construct compressor 10 since only one style of cylinder bank is required for both bank 12*a* which incorporates the unloader valve and bank 12*b* which does not. Furthermore, the cost of providing an unloader valve to control compressor capacity is relatively low as a result of its simplified design and incorporation as an integral part of the cylinder bank 12*a*. The cylinder banks 12 are relatively simple castings since they are separate from all the structure which comprises the crankcase 11. Their simplicity facilitates cleaning out sand particles after the casting operation is complete thereby adding to the expected operating life of compressor 10 and improving its quality.

The design of compressor 10 also permits reduced machining costs since unloader chamber 40, cylinders 18, and discharge passage 45 all lie upon a common center line, permitting them to be bored from the same side of cylinder bank 12. Likewise, lip 51 can be machined inside chamber 40 without repositioning cylinder bank 12.

The present embodiment illustrates a compressor 10 having four cylinders 18. It will be apparent, that a third cylinder bank 12 could be provided, thereby adding an additional two cylinders 18. A second electrical solenoid valve 71 and second pairs of tubes 72 and 73 would then be required to unload the third cylinder bank in order to provide the compressor with the ability to operate in three load conditions, i.e., with either two, four, or six cylinders loaded. Likewise, a two-cylinder compressor could be built according to the present invention, in which only one of the cylinders may be unloaded, provided the other cylinder were supplied suction gas independently of the one cylinder.

It will be apparent that a sleeve could be inserted into chamber 40 to eliminate machining its bore, and that this sleeve could include a lip or shoulder to provide a seal against unloader piston 50 in lieu of lip 51. Such a sleeve would still be an integral part of the cylinder bank 12*a*. However, such an insert is believed more expensive than machining chamber 40 and lip 51.

Structural details of compressor 10 which are considered unnecessary to the understanding and full disclosure of the subject invention have not been shown nor explained. These details, however, are well known to those skilled in the art and can be readily provided without undue experimentation.

While the present invention has been described with respect to the preferred embodiment, it is to be understood that further modifications thereto would become apparent to those skilled in the art, which modifications lie within the scope of the present invention as defined in the claims which follow.

We claim:

1. A reciprocating compressor comprising a. a casing defining a plurality of cylinder banks, each including a discharge passage and a plurality of cylinders in which a fluid may be compressed by the reciprocating motion of pistons;

b. a valve assembly adjacent to one end of each cylinder, said valve assembly including a suction valve and a discharge valve;

c. suction gas passages formed within each cylinder bank, generally circumjacent the cylinders, in fluid communication with the suction valves;

d. a discharge gas chamber overlying the valve assemblies of each cylinder bank, in fluid communication with the discharge valves of each cylinder in the bank and with the discharge passage through which fluid compressed in the cylinders is discharged, each discharge passage having an axial center in parallel alignment with the axial centers of the cylinders disposed in its cylinder bank; and e. an unloading valve for controlling fluid flow into the suction gas passages of all the cylinders in at least one of the cylinder banks, said unloading valve including an unloader chamber and an unloader port, both disposed within the cylinder bank as an integral part thereof, and an unloader piston that is movable within said unloader chamber, to seal the unloader port to control fluid flow through the unloading valve, said unloader chamber having an axial center in parallel alignment with the axial center of all the cylinders disposed in the same cylinder bank as the unloading valve.

2. The reciprocating compressor of claim 1 wherein the casing includes a crankcase detachably mounted to the cylinder banks.

3. The reciprocating compressor of claim 2 wherein the cylinder bank and the crankcase are separate metal castings.

4. The reciprocating compressor of claim 1 further comprising means to selectively actuate the unloader piston by application of the compressed fluid discharged from at least one of the cylinders.

5. The reciprocating compressor of claim 4 wherein said actuating means include a solenoid valve for controlling the application of the compressed fluid to the unloader piston.

6. The reciprocating compressor of claim 1 wherein the cylinder banks comprise a first and a second cylinder, and means for unloading at least one of said banks by operation of said unloading valve.

7. A reciprocating compressor comprising a. a casing defining a plurality of cylinder banks, including a discharge passage and a plurality of cylinders bored into the casing wherein each cylinder is provided with a piston for compressing a fluid by its reciprocating movement within the cylinder, said casing further defining a suction gas passage disposed within each cylinder bank in generally contiguous and circumjacent relationship to the cylinders;

b. a valve assembly disposed adjacent to and adjoining one end of each cylinder, each of said valve assemblies including a suction valve and a discharge valve, said suction valves being in fluid communication with the suction gas passage circumjacent its associated cylinder;

c. an inlet port disposed adjacent the casing, for admitting fluid to be compressed into the suction gas passages;

d. a discharge gas chamber overlying the valve assemblies of each cylinder bank in fluid communication with the discharge valves of each cylinder in the bank and by way of the discharge gas passage, in fluid communication with a discharge port; said discharge passage having an axial center in parallel alignment with the axial centers of the cylinders disposed in its cylinder bank; and e. an unloading valve for controlling fluid flow into the suction gas passages of all the cylinders in at least one of the cylinder banks, including (i) an unloader chamber contiguous to the suction gas passages and integral to said at least one cylinder bank, said unloader chamber including a cylindrical shaped portion extending into said cylinder bank with an axial center parallel to the axial center of all the cylinders disposed therein;

(ii) an unloader port adjacent one end of the unloader chamber and also integral to said cylinder bank; and (iii) an unloader piston slideably disposed within said unloader chamber and operative to seal the unloader port to control the flow of fluid from the inlet port to the suction gas passages and suction valves of said cylinder bank.

8. The reciprocating compressor of claim 7 further comprising an electrical solenoid valve for controlling the application of compressed fluid discharged from at least one of the cylinders to actuate the unloader piston.

9. The reciprocating compressor of claim 7 wherein the casing includes a crankcase, said cylinder banks being detachably mounted to the crankcase.

10. The reciprocating compressor of claim 9 wherein the unloader valve is operative to selectively unload at least one cylinder bank.

11. The reciprocating compressor of claim 7 further comprising a plurality of cylinder cover plates, said cylinder cover plates enclosing the valve assemblies, and defining the discharge gas chambers.

12. The reciprocating compressor of claim 11 wherein the, axial centers of the discharge gas passage, the unloader port, and at least one of the cylinder bores are co-planar, to facilitate ease of manufacture.

* * * * *